US006016577A

United States Patent [19]

Cooley

[11] Patent Number: 6,016,577

[45] Date of Patent: Jan. 25, 2000

[54] TOILET ANTI-OVERFLOW DEVICE

[76] Inventor: Donald D. Cooley, 4966 S. Urban Ct., Morrison, Colo. 80465

[21] Appl. No.: 09/176,837

[22] Filed: Oct. 22, 1998

[51] Int. Cl.[7] ..... E03D 11/02

[52] U.S. Cl. ..... 4/427

[58] Field of Search ..... 4/427, 437

[56] References Cited

U.S. PATENT DOCUMENTS 1,956,087 4/1934 Tracy ..... 4/427

*Primary Examiner*—Henry J. Recla
*Assistant Examiner*—Tuan Nguyen

[57] ABSTRACT

A toilet anti-overflow device for preventing a toilet bowl from overflowing by a flapper that is stuck in an open position over a flush valve seat. The toilet anti-overflow device includes a toilet with a toilet bowl and a water tank in fluid communication with the toilet bowl. The water tank has a flush valve seat therein and an overflow tube upwardly extending from the flush valve seat. The water tank has a flexible flapper pivotally coupled to the overflow tube and covering the flush valve seat. A collar is slidably disposed around overflow tube. One end of an elongate flexible cable is coupled to the collar. The other end of the cable is wrapped around a spool coupled to a rotating shaft of a motor. A controller is electrically connected to the motor to selectively energize the motor to selectively rotate the rotating shaft. A switch is provided in the toilet bowl and is electrically connected to the controller. The switch activates the controller to energize the motor when the water level in the toilet bowl rises above a predetermine level.

10 Claims, 4 Drawing Sheets

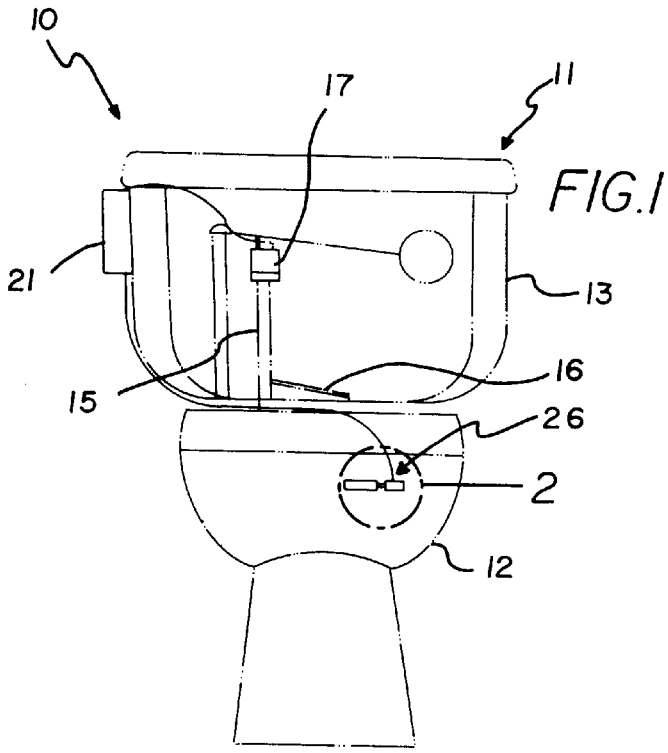
FIG.1
FIG.2
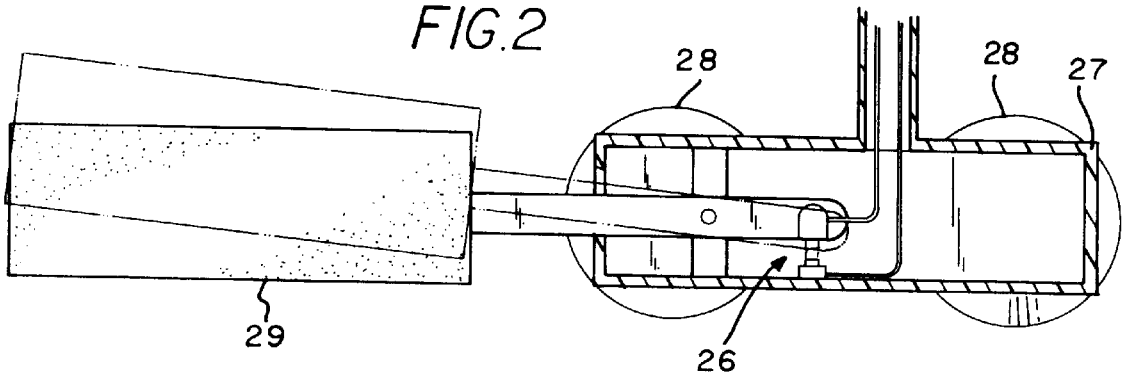

TOILET ANTI-OVERFLOW DEVICE

BACKGROUND OF THE INVENTION

1. Field of the Invention

The present invention relates to devices for preventing a toilet from overflowing and more particularly pertains to a new toilet anti-overflow device for preventing a toilet bowl from overflowing by a flapper that is stuck in an open position over a flush valve seat.

2. Description of the Prior Art

The use of devices for preventing a toilet from overflowing is known in the prior art. More specifically, devices for preventing a toilet from overflowing heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,191,662; U.S. Pat. No. 4,910,812; U.S. Pat. No. 4,748,699; U.S. Pat. No. 4,633,534; U.S. Pat. No. Des. 347,881; and U.S. Pat. No. 5,083,323.

While these devices fulfill their respective, particular objectives and requirements, the aforementioned patents do not disclose a new toilet anti-overflow device. The inventive device includes a toilet with a toilet bowl and a water tank in fluid communication with the toilet bowl. The water tank has a flush valve seat therein and an overflow tube upwardly extending from the flush valve seat. The water tank has a flexible flapper pivotally coupled to the overflow tube and covering the flush valve seat. A collar is slidably disposed around overflow tube. One end of an elongate flexible cable is coupled to the collar. The other end of the cable is wrapped around a spool coupled to a rotating shaft of a motor. A controller is electrically connected to the motor to selectively energize the motor to selectively rotate the rotating shaft. A switch is provided in the toilet bowl and is electrically connected to the controller. The switch activates the controller to energize the motor when the water level in the toilet bowl rises above a predetermine level.

In these respects, the toilet anti-overflow device according to the present invention substantially departs from the conventional concepts and designs of the prior art, and in so doing provides an apparatus primarily developed for the purpose of preventing a toilet bowl from overflowing by a flapper that is stuck in an open position over a flush valve seat.

SUMMARY OF THE INVENTION

In view of the foregoing disadvantages inherent in the known types of devices for preventing a toilet from overflowing now present in the prior art, the present invention provides a new toilet anti-overflow device construction wherein the same can be utilized for preventing a toilet bowl from overflowing by a flapper that is stuck in an open position over a flush valve seat.

The general purpose of the present invention, which will be described subsequently in greater detail, is to provide a new toilet anti-overflow device apparatus and method which has many of the advantages of the devices for preventing a toilet from overflowing mentioned heretofore and many novel features that result in a new toilet anti-overflow device which is not anticipated, rendered obvious, suggested, or even implied by any of the prior art devices for preventing a toilet from overflowing, either alone or in any combination thereof.

To attain this, the present invention generally comprises a toilet with a toilet bowl and a water tank in fluid communication with the toilet bowl. The water tank has a flush valve seat therein and an overflow tube upwardly extending from the flush valve seat. The water tank has a flexible flapper pivotally coupled to the overflow tube and covering the flush valve seat. A collar is slidably disposed around overflow tube. One end of an elongate flexible cable is coupled to the collar. The other end of the cable is wrapped around a spool coupled to a rotating shaft of a motor. A controller is electrically connected to the motor to selectively energize the motor to selectively rotate the rotating shaft. A switch is provided in the toilet bowl and is electrically connected to the controller. The switch activates the controller to energize the motor when the water level in the toilet bowl rises above a predetermine level.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toilet anti-overflow device apparatus and method which has many of the advantages of the devices for preventing a toilet from overflowing mentioned heretofore and many novel features that result in a new toilet anti-overflow device which is not anticipated, rendered obvious, suggested, or even implied by any of the prior art devices for preventing a toilet from overflowing, either alone or in any combination thereof.

It is another object of the present invention to provide a new toilet anti-overflow device which may be easily and efficiently manufactured and marketed.

It is a further object of the present invention to provide a new toilet anti-overflow device which is of a durable and reliable construction.

An even further object of the present invention is to provide a new toilet anti-overflow device which is susceptible of a low cost of manufacture with regard to both materials and labor, and which accordingly is then susceptible of low prices of sale to the consuming public, thereby making such toilet anti-overflow device economically available to the buying public.

Still yet another object of the present invention is to provide a new toilet anti-overflow device which provides in the apparatuses and methods of the prior art some of the advantages thereof, while simultaneously overcoming some of the disadvantages normally associated therewith.

Still another object of the present invention is to provide a new toilet anti-overflow device for preventing a toilet bowl from overflowing by a flapper that is stuck in an open position over a flush valve seat.

Yet another object of the present invention is to provide a new toilet anti-overflow device which includes a toilet with a toilet bowl and a water tank in fluid communication with the toilet bowl. The water tank has a flush valve seat therein and an overflow tube upwardly extending from the flush valve seat. The water tank has a flexible flapper pivotally coupled to the overflow tube and covering the flush valve seat. A collar is slidably disposed around overflow tube. One end of an elongate flexible cable is coupled to the collar. The other end of the cable is wrapped around a spool coupled to a rotating shaft of a motor. A controller is electrically connected to the motor to selectively energize the motor to selectively rotate the rotating shaft. A switch is provided in the toilet bowl and is electrically connected to the controller. The switch activates the controller to energize the motor when the water level in the toilet bowl rises above a predetermine level.

Still yet another object of the present invention is to provide a new toilet anti-overflow device that helps prevent a clogged toilet bowl from overflowing due to the flapper in the toilet tank stuck in an open position uncovering the flush valve seat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic front view of a new toilet anti-overflow device according to the present invention.

FIG. 2 is a schematic enlarged view of the switch of the present invention taken from the circle 2 of FIG. 1.

DESCRIPTION OF THE PREFERRED EMBODIMENT

Figure 3:
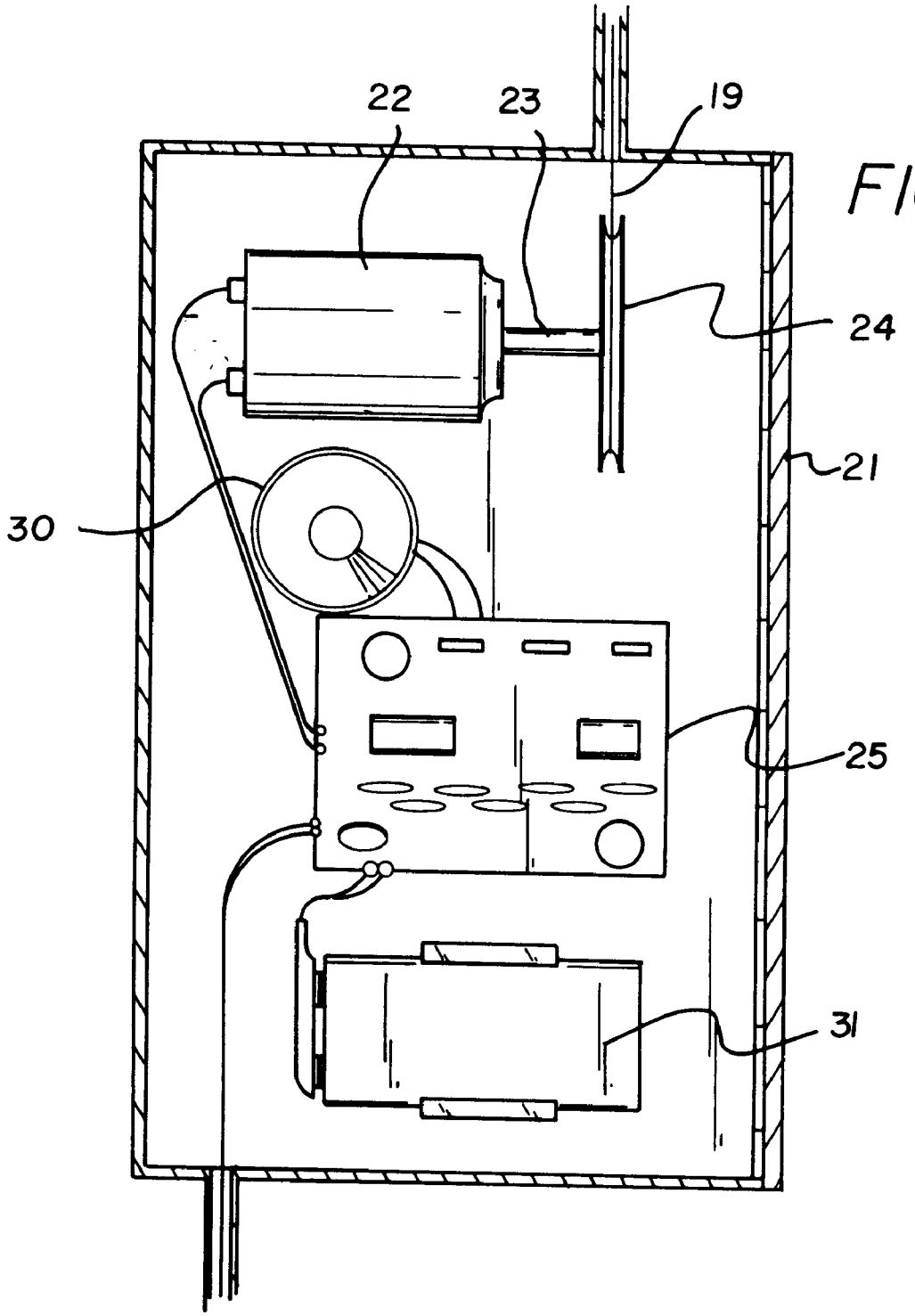
FIG. 3 is a schematic cross sectional view of the housing of the present invention.

With reference now to the drawings, and in particular to FIGS. 1 through 6 thereof, a new toilet anti-overflow device embodying the principles and concepts of the present invention and generally designated by the reference numeral 10 will be described.

As best illustrated in FIGS. 1 through 6, the toilet anti-overflow device 10 generally comprises a toilet 11 with a toilet bowl 12 and a water tank 13 in fluid communication with the toilet bowl 12. The water tank 13 has a flush valve seat 14 therein and an overflow tube 15 upwardly extending from the flush valve seat 14. The water tank 13 has a flexible flapper 16 pivotally coupled to the overflow tube 15 and covering the flush valve seat 14. A collar 17 is slidably disposed around overflow tube 15. One end of an elongate flexible cable 19 is coupled to the collar 17. The other end of the cable is wrapped around a spool 24 coupled to a rotating shaft 23 of a motor 22. A controller 25 is electrically connected to the motor 22 to selectively energize the motor 22 to selectively rotate the rotating shaft 23. A switch 26 is provided in the toilet bowl 12 and is electrically connected to the controller 25. The switch 26 activates the controller 25 to energize the motor 22 when the water level in the toilet bowl 12 rises above a predetermine level.

Figure 4:
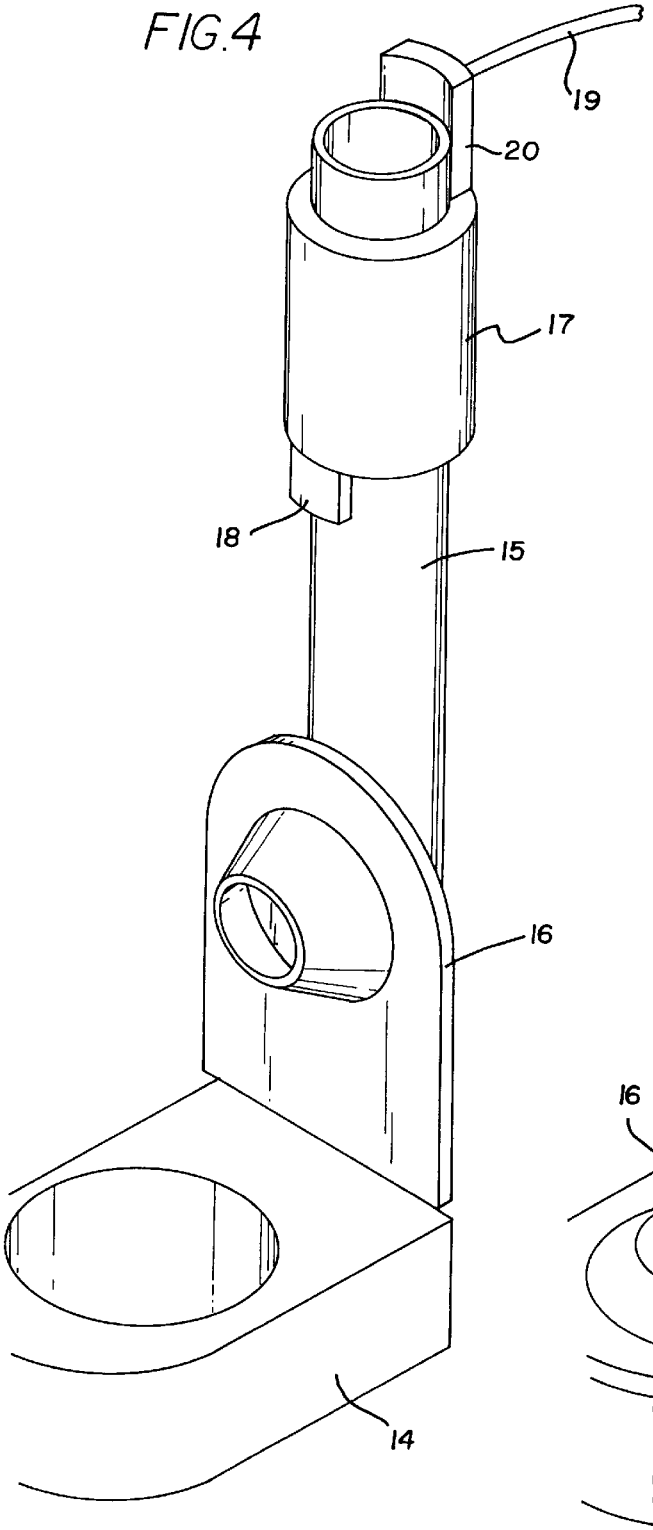
FIG. 4 is a schematic perspective view of the collar in the raised position and the flapper in the uncovered position.
Figure 5:
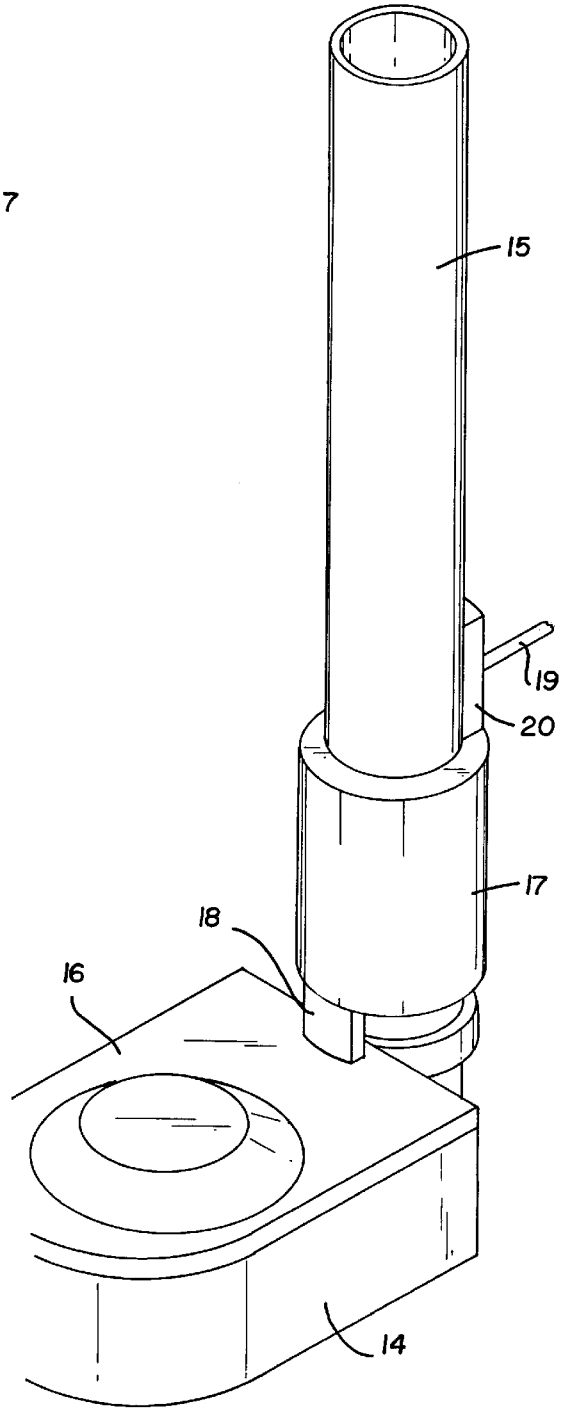
FIG. 5 is a schematic perspective view of the collar in the lowered position to hold the flapper in the covered position to close the opening of the flush valve seat.

In closer detail, the toilet 11 has a toilet bowl 12 and a water tank 13 in fluid communication with the toilet bowl 12. The water tank 13 has a flush valve seat 14 therein providing an opening to the toilet bowl 12 to fluidly connect the water tank 13 to the toilet bowl 12. The water tank 13 has an upwardly extending generally cylindrical overflow tube 15 upwardly extending from the flush valve seat 14. The overflow tube 15 has opposite upper and lower ends. The water tank 13 also has a flexible flapper 16 pivotally coupled to lower end of the overflow tube 15. With reference to FIGS. 4 and 5, the flapper 16 is positionable in a covered position (FIG. 5) and an uncovered position (FIG. 4). The flapper 16 substantially closes the opening of the flush valve seat 14 when the flapper 16 is positioned in the covered position. When the flapper 16 is lifted so that it is positioned in the uncovered position the opening of the flush valve seat 14 is open.

A generally cylindrical collar 17 is slidably disposed around overflow tube 15 to permit sliding of the collar 17 along the overflow tube 15 between the upper and lower ends of the overflow tube 15. The collar 17 has annular top and bottom edges. As illustrated in FIG. 4 and 5, the collar 17 is slidable along the overflow tube 15 between a lowered position (FIG. 5) and a raised position (FIG. 4). When the collar 17 is position in the lowered position, the bottom edge of the collar 17 is positioned towards the lower end of the overflow tube 15 and rests on the flapper 16 to hold the flapper 16 in the covered position. In an ideal optional embodiment, the bottom edge of the collar 17 may have a generally rectangular lower tab 18 downwardly extending therefrom. As illustrated in FIG. 5, the lower tab 18 rests on the flapper 16 when the collar 17 is position in the lowered position. In use, collar 17 is initially positioned towards the upper end of the overflow tube 15 to permit positioning of the flapper 16 in the uncovered position when the toilet 11 is flushed.

One end of an elongate mono-filament flexible cable 19 is coupled to the collar 17. In an ideal optional embodiment, the top edge of the collar 17 has a generally rectangular upper tab 20 upwardly extending therefrom to which the one end of the flexible cable 19 is coupled.

A generally rectangular box-shaped housing 21 is mounted to the exterior of the water tank 13. With reference to FIG. 3, a motor 22 is mounted in the housing 21. The motor 22 has a rotating shaft 23 which the motor 22 rotates when energized. A spool 24 is coupled to the rotating shaft 23 of the motor 22. The other end of the flexible cable 19 is wrapped around spool 24 such that the flexible cable 19 pulls the collar 17 to position the collar 17 in the raised position. In use, rotation of the rotating shaft 23 by the motor 22 in a first direction unwinds the flexible cable 19 from the spool 24 such that the collar 17 is lowered by the flexible cable 19 towards the lowered position. Conversely, rotation of the rotating shaft 23 by the motor 22 in a second direction winds the flexible cable 19 on the spool 24 such that collar 17 is raised by pulling or lifting by the flexible cable 19 towards the raised position.

A controller 25 is mounted in the housing 21. The controller 25 is electrically connected to the motor 22. The controller 25 selectively energizes and de-energizes the motor 22 to selectively rotate the shaft in the first and second directions.

A switch 26 is provided in the toilet bowl 12 as illustrated in FIG. 1. The switch 26 is electrically connected to the controller 25. With reference to FIG. 2, the switch 26 has an outer casing 27 mounted to an interior surface of the toilet bowl 12. Preferably, the outer casing 27 has a pair of suction cups 28 suctionally coupling the outer casing 27 to the interior surface of the toilet bowl 12. The switch 26 also has a pivotally mounted float actuator 29 in the toilet bowl 12. The float actuator 29 is positioned in the toilet bowl 12 at a predetermined level such that the float actuator 29 actuating the switch 26 when the water level in the toilet bowl 12 rises above a predetermined level (i.e., when the toilet bowl 12 starts to overflow). The float actuator 29 has a buoyant portion that floats on the water to pivot the float actuator 29 as the water level in the toilet bowl 12. In use, when the float actuator 29 actuates the switch 26, the switch 26 activates the controller 25 to energize the motor 22 to rotate the shaft in the first direction. This unwinds the flexible cable 19 about the spool 24 to lower the collar 17 into the lowered position. This in turn positions the flapper 16 in the closed position to close the opening of the flush valve seat 14 and thereby prevent more water from entering the toilet bowl 12 to stop the raising of the water level in the toilet bowl 12.

Preferably, a buzzer 30 is mounted in the housing 21. The buzzer 30 emits an audible warning when activated. The buzzer 30 is electrically connected to the controller 25. The controller 25 activates the buzzer 30 when the switch 26 activates the controller 25. A battery power source 31 is also mounted in the housing 21 and electrically connected to the controller 25 to provide energy to the system.

Preferably, in use, the controller 25 energizes the motor 22 to rotate the shaft in the second direction a predetermined amount of time after the controller 25 energized the motor 22 to rotate the shaft in the first direction to re-wind the flexible cable 19 back onto the spool 24. The predetermined amount of time is preferably greater than about 1 minute. Ideally, the predetermined amount of time is greater than about 5 minutes to give time for the toilet bowl 12 to drain and permit use of the toilet by a subsequent user.

Figure 6:
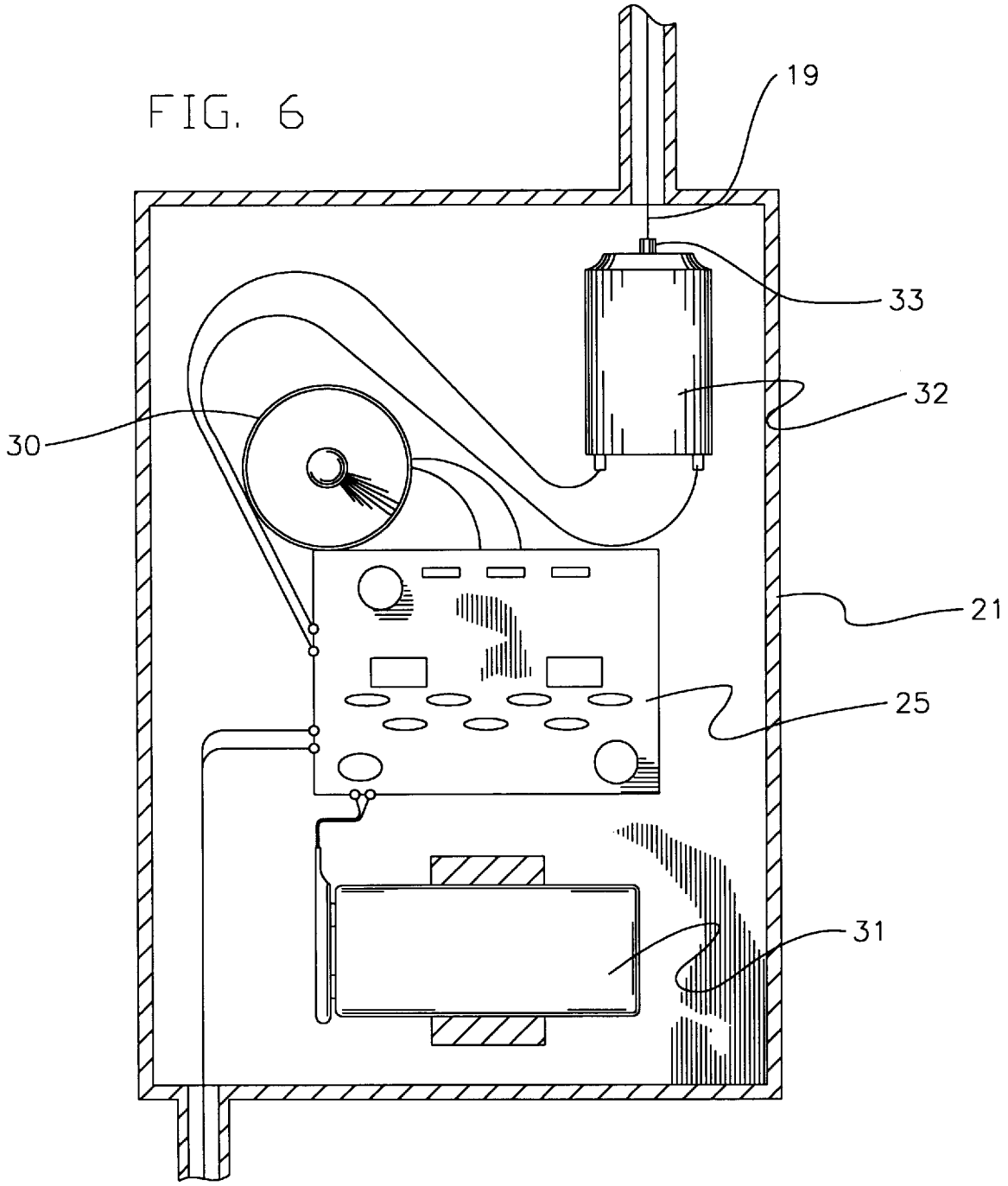
FIG. 6 is a schematic cross sectional view of the housing with the optional solenoid embodiment.

With reference to FIG. 6, in an optional embodiment the motor 22 and spool 24 are replaced with a solenoid 32 having a shaft 33 coupled to the other end of the flexible cable 19. The shaft 33 of the solenoid 32 is retractably extendable to selective move the cable to raise and lower the collar 17. The solenoid is electrically connected to the controller so that the controller may selectively energize the solenoid to extend and retract the shaft of the solenoid. In this embodiment, when the switch is activated by a rising water level in the toilet bowl, the controller activates the solenoid to extend the shaft so that the cable lowers the collar to the lowered position to push the flapper into the covered position.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. In combination:

a toilet having a toilet bowl and a water tank in fluid communication with said toilet bowl;

said water tank having a flush valve seat therein and an overflow tube upwardly extending from said flush valve seat;

said water tank having a flexible flapper pivotally coupled to said overflow tube and covering said flush valve seat;

a collar being slidably disposed around overflow tube;

an elongate flexible cable having a pair of opposite ends, one of said ends of said flexible cable being coupled to said collar;

a motor having a rotating shaft;

a spool being coupled to said rotating shaft of said motor;

the other end of said flexible cable being wrapped around spool;

a controller being electrically connected to said motor, said controller selectively energizing said motor to selectively rotate said rotating shaft;

a switch being provided in said toilet bowl, said switch being electrically connected to said controller; and said switch activating said controller to energize said motor when the water level in said toilet bowl rises above a predetermine level.

2. The combination of claim 1, wherein said collar has annular top and bottom edges, wherein said bottom edge of said collar has a lower tab downwardly extending therefrom.

3. The combination of claim 1, wherein said collar has annular top and bottom edges, wherein said top edge of said collar has a upper tab upwardly extending therefrom, and wherein said one end of said flexible cable is coupled to said upper tab of said collar.

4. The combination of claim 1, wherein rotation of said rotating shaft by said motor in a first direction unwinds said flexible cable from said spool, wherein rotation of said rotating shaft by said motor in a second direction winds said flexible cable on said spool, and wherein said switch activates said controller to energize said motor to rotate said shaft in said first direction.

5. The combination of claim 4, wherein said controller energizes said motor to rotate said shaft in said second direction a predetermined amount of time after said controller energized said motor to rotate said shaft in said first direction.

6. The combination of claim 5, wherein said predetermined amount of time is greater than about 1 minute.

7. The combination of claim 5, wherein said predetermined amount of time is greater than about 5 minutes.

8. The combination of claim 1, further comprising a buzzer being electrically connected to said controller.

9. The combination of claim 1, further comprising a battery power source being electrically connected to said controller.

10. In combination:

a toilet having a toilet bowl and a water tank;

said water tank having a flush valve seat therein providing an opening to said toilet bowl to fluidly connect said water tank to said toilet bowl;

said water tank having an upwardly extending overflow tube upwardly extending from said flush valve seat, said overflow tube having opposite upper and lower ends;

said water tank having a flexible flapper pivotally coupled to lower end of said overflow tube;

said flapper being positionable in a covered position and an uncovered position, wherein said flapper substantially closes said opening of said flush valve seat wherein said flapper is positioned in said covered position, wherein said opening of said flush valve seat is open when said flapper is positioned in said uncovered position;

a collar being slidably disposed around overflow tube to permit sliding of said collar along said overflow tube between said upper and lower ends of said overflow tube;

said collar having annular top and bottom edges;

said collar being slidable along said overflow tube between a lowered and a raised position;

wherein said bottom edge of said collar is positioned towards said lower end of said overflow tube and rests on said flapper to hold said flapper in said covered position when said collar is position in said lowered position;

wherein said bottom edge of said collar has a lower tab downwardly extending therefrom, said lower tab resting on said flapper when said collar is position in said lowered position;

wherein said collar is positioned towards said upper end of said overflow tube to permit positioning of said flapper in said uncovered position;

an elongate flexible cable having a pair of opposite ends, one of said ends of said flexible cable being coupled to said collar;

wherein said top edge of said collar has a upper tab upwardly extending therefrom, said one end of said flexible cable being coupled to said upper tab of said collar;

a housing being mounted to said water tank;

a motor being mounted in said housing, said motor having a rotating shaft;

a spool being coupled to said rotating shaft of said motor;

the other end of said flexible cable being wrapped around spool such that said flexible cable pulls said collar to position said collar in said raised position;

wherein rotation of said rotating shaft by said motor in a first direction unwinds said flexible cable from said spool such that said collar is lowered by said flexible cable towards said lowered position;

wherein rotation of said rotating shaft by said motor in a second direction winds said flexible cable on said spool such that collar is raised by said flexible cable towards said raised position;

a controller being mounted in said housing, said controller being electrically connected to said motor, said controller selectively energizing said motor to selectively rotate said shaft in said first and second directions;

a switch being provided in said toilet bowl, said switch being electrically connected to said controller;

said switch having an outer casing mounted to an interior surface of said toilet bowl, wherein said outer casing has a pair of suction cups suctionally coupling said outer casing to said interior surface of said toilet bowl;

said switch having a pivotally mounted float actuator in said toilet bowl;

said float actuator being positioned in said toilet bowl at a predetermined level such that said float actuator actuating said switch when the water level in said toilet bowl rises above a predetermined level;

said switch activating said controller to energize said motor to rotate said shaft in said first direction when said float actuator actuates said switch;

a buzzer being mounted in said housing, said buzzer emitting an audible warning when activated, said buzzer being electrically connected to said controller, said controller activating said buzzer when said switch activates said controller;

a battery power source being mounted in said housing, said battery power source being electrically connected to said controller;

said controller energizing said motor to rotate said shaft in said second direction a predetermined amount of time after said controller energized said motor to rotate said shaft in said first direction to re-wind said flexible cable back onto said spool; and wherein said predetermined amount of time is greater than about 1 minute.

* * * * *